US006843092B2

(12) United States Patent
Greenberg et al.

(10) Patent No.: US 6,843,092 B2
(45) Date of Patent: Jan. 18, 2005

(54) ARCHITECTURAL PANEL ARCHING DEVICE

(75) Inventors: Percy Greenberg, Minnetonka, MN (US); Leonard A. Jacobsson, Brooklyn Center, MN (US); Wayne M. Wagner, West St. Paul, MN (US)

(73) Assignee: Crown-PN L.L.C., Anoka, MN (US)

( * ) Notice: Subject to any disclaimer, the term of this patent is extended or adjusted under 35 U.S.C. 154(b) by 265 days.

(21) Appl. No.: 10/036,926

(22) Filed: Oct. 19, 2001

(65) Prior Publication Data

US 2003/0136166 A1 Jul. 24, 2003

(51) Int. Cl.[7] ..... B21D 5/14
(52) U.S. Cl. ..... 72/173; 72/166
(58) Field of Search ..... 72/173, 174, 171, 72/170, 166

(56) References Cited

U.S. PATENT DOCUMENTS

| | | | | | |
|---|---|---|---|---|---|
| 93,181 | A | | 8/1869 | Cushing | |
| 629,496 | A | * | 7/1899 | Diescher | 72/171 |
| 1,002,907 | A | | 9/1911 | Dunn | |
| 1,804,468 | A | * | 5/1931 | Jensen | 72/171 |
| 1,905,515 | A | * | 4/1933 | Smith | 72/174 |
| 2,279,197 | A | * | 4/1942 | Hoell | 72/171 |
| 2,339,355 | A | * | 1/1944 | Rutten | 72/129 |
| 2,505,241 | A | | 4/1950 | Gray et al. | 153/28 |
| 3,023,800 | A | * | 3/1962 | White et al. | 72/173 |
| 3,248,198 | A | | 4/1966 | Jamnik et al. | 65/245 |
| 3,339,392 | A | | 9/1967 | Buckwalter et al. | 72/166 |
| 3,710,607 | A | | 1/1973 | Beymer | 72/30 |
| 4,660,399 | A | | 4/1987 | Suter et al. | 72/181 |
| 4,716,754 | A | | 1/1988 | Youngs | 72/178 |
| 4,723,431 | A | * | 2/1988 | McKindary | 72/173 |
| 4,850,212 | A | * | 7/1989 | Frey | 72/166 |
| 4,864,837 | A | | 9/1989 | Fielden, Jr. | 72/176 |
| 4,910,984 | A | * | 3/1990 | Young et al. | 72/14.7 |
| 5,253,501 | A | | 10/1993 | Spath | 72/167 |
| 5,394,722 | A | | 3/1995 | Meyer | 72/129 |
| 5,632,174 | A | * | 5/1997 | Hunter | 72/129 |
| 5,664,451 | A | | 9/1997 | Schultz | 72/181 |
| 6,115,899 | A | | 9/2000 | Rider | 29/243.5 |

* cited by examiner

*Primary Examiner*—Daniel C. Crane
(74) *Attorney, Agent, or Firm*—Nawrocki, Rooney & Sivertson, P.A.

(57) ABSTRACT

Apparatus for forming an arch is architectural panels including a drive section and an arching section. Each of the drive section and arching section have at least one roller and cooperating follower with the rollers being adapted to engage the underside of the panel with a groove in the followers accepting side legs of the panel. In a preferred embodiment, two cooperating followers float along a common shaft in association with each roller.

27 Claims, 12 Drawing Sheets

ARCHITECTURAL PANEL ARCHING DEVICE

BACKGROUND OF THE INVENTION

The present invention relates generally to architectural panels and, more particularly, to an apparatus for forming radius panels and cooperating battens.

Architectural panels in various configurations are well known in the prior art. A common example is the standing seam panel which is, essentially, an elongated rectangular panel having upstanding legs along the sides—the legs forming the seam between adjacent panels. In a typical standing seam roof structure, a batten is employed over the legs of adjacent panels to seal the seam between the panels. Because of the extension of the legs, this seam is "standing." That is, the seam is positioned vertically from the plane of the roof itself.

Because of its planar nature, typical standing seam (and similar architectural panels) are easily fabricated and transported. Indeed, in some instances the simplicity of the bends allows their fabrication in the field. More complex (i.e., arched or radius panels, for example) pose one of two problems. Because of their complexity relative to flat panels, arched or radius panels are difficult to form in the field. On the other hand, a radius panel that is fabricated at a manufacturing location poses difficulties in shipment. Their curvature causes a small number of panels to occupy a large amount of space which may result in the use of multiple trucks for a relatively light load.

SUMMARY OF THE INVENTION

The present invention provides a device for forming radius panels that is sufficiently portable to be employed in the field. As a result, panels may be shipped to the work site in a flat configuration and arched in the field, to the desired configuration, thereby reducing shipping costs.

In a preferred embodiment, the present invention provides a device for forming an arch along the longitudinal axis of an architectural panel. A common application for such panels is the covering of domes of various construction. Dependent upon the particular dome configuration, the panels may be generally rectangular or have a taper from one end to the other, the latter being required in the familiar onion dome.

In its basic form, a device in accordance with the present invention provides a drive section which accepts the panel, including the upstanding legs, and advances it toward an arching section. The arching section includes a supporting roller having a top surface which is generally coplanar with the plane of the advancing panel and an arching roller pivotable about the rotational axis of the supporting roller. The arching roller causes the advancing panel to deviate from its path thereby producing an arch in the panel, the degree of the arch being determined by the position of the arching roller relative to the supporting roller.

As described above, one feature of typical architectural panels is an upstanding leg along the sides. These legs provide a longitudinal stability to the panel and are the element upon which a device in accordance with the present invention operates to "set" an arch in the panel. These legs are accommodated in grooves in rollers or blocks within the drive section and corresponding structures in the arching section. For the tapered panel, these grooves must "move" transverse to the direction of panel movement to accommodate the changing spacing between the legs of the advancing panel. This is provided in accordance with the present invention with the groove width also being adjustable to accommodate varying tapers in the panels being operated upon.

In an alternative embodiment in accordance with the present invention, the battens employed to seal the seams between adjacent radius panels are also arched to a corresponding curve. This is accomplished through the use of a drive section of rollers and an arching section including an arching roller pivotable relative to the rotational axis of a supporting roller in a manner similar to that described with reference to the panel arching device.

DETAILED DESCRIPTION OF THE INVENTION

Figure 1:
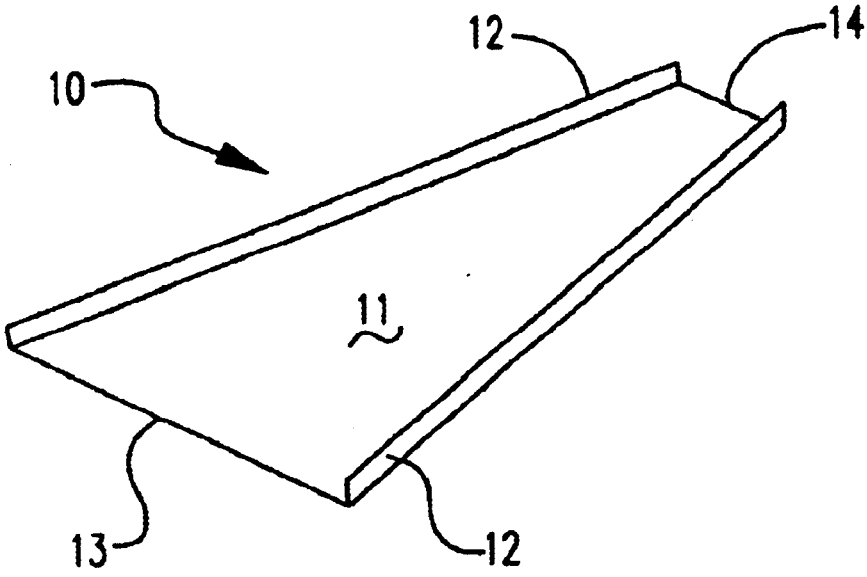
FIG. 1 illustrates a tapered panel on which a device in accordance with the present invention operates.

FIG. 1 illustrates a tapered panel which, when arched or curved along its longitudinal axis, is employed in onion domes and similar known configurations. Other curved or arched panels may be formed in accordance with the present invention. However, the tapered panel illustrated in FIG. 1 provides a unique set of difficulties and the present invention is described herein chiefly with reference to such a tapered panel. As illustrated, the panel 10 includes an elongated, generally planar pan section 11 and upstanding side legs 12, the legs 12 extending along the sides of the pan 11. The end 13 has a longer transverse dimension than the end 14, the particular dimensions being dependent upon the application/design of the structure to which the panel will be applied.

Figure 2:
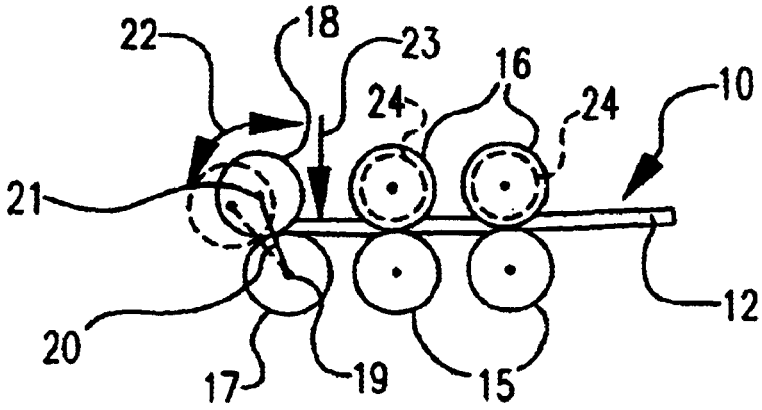
FIG. 2 is a schematic representation illustrating the chief operational characteristics of a device in accordance with the present invention.

FIG. 2 illustrates a side view of a device for forming a radius or arch in a panel such as that illustrated at 10 in FIG. 1. The device of FIG. 2 includes a driving section including driven rollers 15 and followers 16. The followers include grooves, described more fully below, for accepting the side legs 12 of the panel. The followers 16 urge the underside of the panel 10 against the driven rollers 15 causing the panel to advance (from right to left in the illustrated embodiment) on rotation of the rollers 15. As illustrated, the driving section includes two sets of rollers/followers. In some instances, a single roller/follower assembly may be all that is necessary while additional rollers/followers may be employed in others. A primary consideration is that the panels 10 are prefinished and it is necessary to advance the panel 10 without harm to the finish. For most applications, it is believed that a two station driving section will provide the necessary advancing force without harm to the finish of the panel 10.

Advance of the panel 10 directs it to an additional roller 17 within the arching section. The upper surface/contact point between the roller 17 and the panel 10 is generally coplanar with the pan 11 of the panel 10 (see FIG. 1). An arching follower 18 is pivotally connected to the rotational axis 19 of the roller 17 by a link 20. The link 20 extends from the axis 19 of roller 17 to the rotational axis 21 of the follower 18 allowing the follower 18 to move in the directions of the arrow 22. The follower 18 may be positioned directly above the roller 17 such that the panel will pass through the arching section (consisting essentially of roller 17 and follower 18) without providing an arch to the panel 10. However, an urging of the follower 18 in the direction of the movement of the panel 10 causes the follower 18 to pivot downwardly relative to the plane of the pan 11, this position being illustrated in phantom in FIG. 2. With the follower 18 in such an arching position, further advance of the panel 10 will deflect the panel 10 downwardly causing the legs 12 to stretch and set an arch in the panel 10.

It will be apparent to those familiar with the art that there will be a flat in the trailing portion of the panel 10, the length of the flat section being determined by the spacing between the last roller/follower 15 and 16 of the driving section and the arching section. This flat may be minimized by positioning those driving section rollers/followers closer to the arching section. Alternatively, an additional follower may be provided close to the arching section as represented by the arrow 23.

The followers 16 include a groove for accepting the legs 12 of the panel 10. These grooves are represented in FIG. 2 at 24. With a rectangular panel, these grooves may be stationary and simply formed in the followers 16 generally coextensive with the driven rollers 15. However, with tapered panels such as that illustrated in FIG. 1, the grooves 24 must move as the panel advances to accommodate changes in the spacing between the legs from one end of the panel to the other. This is accomplished in a manner described more fully below. Similar grooves 24 are provided in the follower 18, those grooves not being illustrated in FIG. 2 for the sake of clarity.

Figure 3:
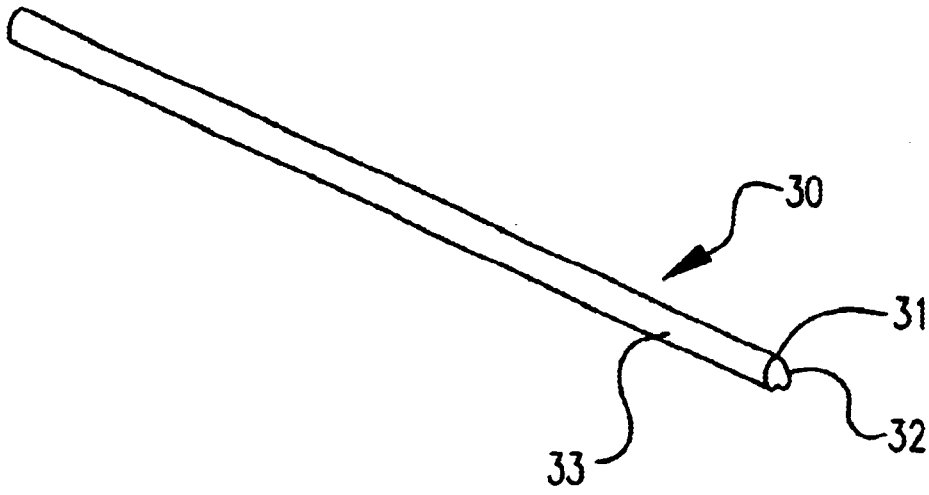
FIG. 3 illustrates a batten on which a device such that illustrated in FIG. 2 operates.

FIG. 3 illustrates a batten of the type used to close the seam between adjacent panels on a roof. The manner of fixing such battens to the panel legs 12 is well known in the art. Typically, clips are employed on the legs 12 with the batten engaging those clips. Indeed, the manner of fixing the panels themselves is well known in the art. The present invention is directed to the formation of a radius or arch in the panels and battens with the manner of securing those members to a structure forming no part of the present invention. For the purpose of this specification and claims, the term "architectural panel" includes traditional panels as well as battens.

In the context of the present invention, the batten 30 includes an upper nose section 31 with depending side legs 32 and 33. As is known in the art, the ends of the legs 32 and 33 are curled to provide an edge for engaging the clips described above.

To employ the device of FIG. 2 for the formation of an arch or radius in the batten of FIG. 3, the grooves 24 of the followers 16 and 18 are configured to generally correspond to the cross section of the batten 30. The rollers 15 and 17 may be provided with a disc-like member which extends into the grooves to create a frictional fit between the rollers 15 and 17, the followers 16 and 18, and the batten 30. To assure the batten 30 advances through the device of FIG. 2 without harm to the surface finish of the batten 30, each of the rollers/followers 15–18 are synchronously driven so that there is no surface chafing or galling. As the batten 30 advances through the device it is engaged and urged downwardly by the follower 18 resulting in a radius or arch in the batten 30 in a manner similar to that described above with reference to the panel 10.

Figure 4:
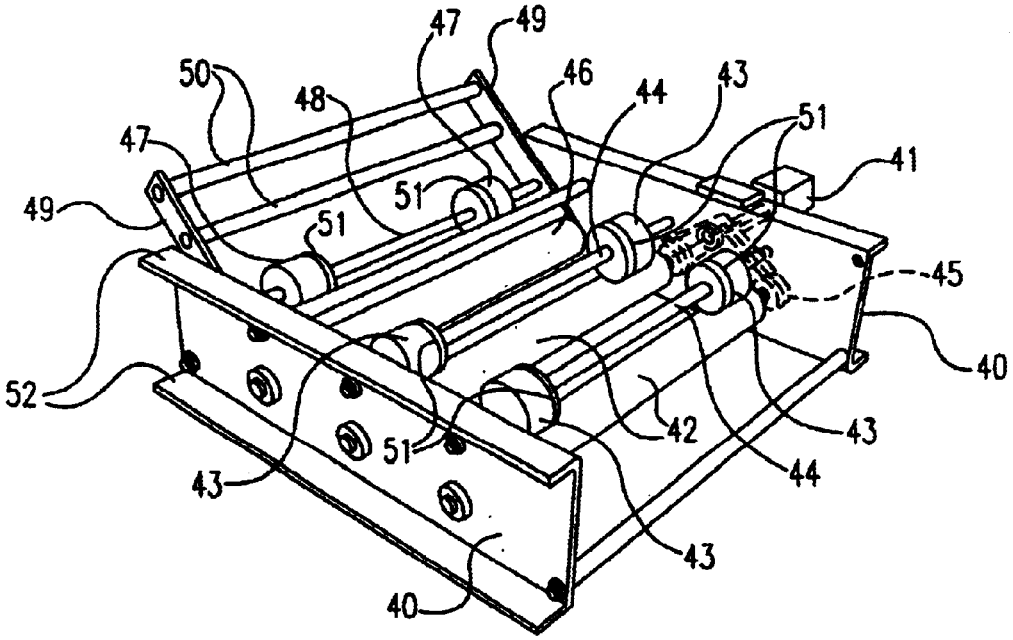
FIG. 4 illustrates a panel arching device in accordance with the present invention.

FIG. 4 illustrates an assembly capable of providing an arch or radius to a panel of the type illustrated in FIG. 1. Specifically, the device of FIG. 4 includes side supports 40 which carry the rollers/followers which form the driving section and arching section as well as a driving mechanism 41. A pair of driven rollers 42 define a driving section in conjunction with follower blocks 43. The follower blocks 43 are mounted on shafts 44 and are movable along the shafts 44 to float between the members 40. A chain or belt and pulley system connects the driving mechanism 41 to the shaft of the rollers 42 which, on rotation of the rollers 42, causes a panel to advance through the device. The driving mechanism 41 may be any convenient type, including the self contained motor or a driving shaft which may be driven by an electric drill. The drive mechanism 41 assures that the rollers 42 rotate synchronously. In some instances, it may be desirable to drive the roller 46 synchronously with the rollers 42.

The arching section consists of a roller 46 and follower blocks 47. The follower blocks 47 may be identical to the follower blocks 43 and are carried on a shaft 48 which extends between links 49. Links 49 are pivotable about the axis of rotation of the roller 46 such that rotation of the links 49 causes the follower blocks 47 to move as indicated by the arrow 22 in FIG. 2. The roller 46 may be generally identical to the rollers 42 with its top surface lying within the same plane as the tops of the rollers 42 such that a panel advancing through the device passes from the roller 42 closest to the roller 46 to lie atop the surface of the roller 46. The roller 46 may be free wheeling or synchronously driven with the rollers 42 while the surface of the rollers 42 and 46 are covered with a resilient friction enhancing material to facilitate the advance of the panel through the device, in known manner. Rods 50 extend between the links 49 to assure a common motion of the links 49 while providing a handle by which the follower blocks 47 are pivoted about the rotational axis of the roller 46.

The follower blocks 43 and 47 are provided with grooves 51 which accept the upstanding side legs 12 of a panel such as that illustrated at 10 in FIG. 1. As described more fully below, the width of grooves 51 is adjustable for the thickness of the material forming the legs 12 and, more importantly, for the angle of the diverging sides (as the panel passes through the machine). The greater the divergence, the greater the gap such that the legs 12 may pass through the grooves without lateral deformation. The follower blocks, through the action of the panel legs 12 within the grooves 51, will float along the shafts 44.

In operation, the follower blocks 43 and 47 are aligned with each other while each of the follower blocks which share a common shaft are spaced from each other such that their grooves 51 correspond to the spacing between the legs 12 at either end 13, 14 of the panel 10 (see FIG. 1). The driving mechanism 41 is then activated and a panel is manually fed with the legs 12 within the grooves 51 of the leading driving section rollers/follower combination. The leading driving roller 42 causes the panel to advance to the second driving roller 42 with the two rollers then advancing the panel into the arching section—over the top of the roller 46. A pressure applied to the links 49 via the rods 50 will urge the panel downwardly producing an arch in the panel to produce a radius panel of desired configuration. Obviously, the amount of movement of the links 49 controls the radius in the formed radius panel and a scale may be provided on either of the members 40 to establish predetermined radii in the resulting radius panel. It is presently contemplated that the leading roller 42 follower block 43 combination will have a looser fit than the second roller/follower block in the driving section. Indeed, as described more fully below, that portion of the follower blocks 51 which engages the pan 11 of the panel 10 (see FIG. 1) has a slightly larger diameter than the remaining portion of the follower block to assure that the interaction between the follower blocks 43 and rollers 41 is through the material of the panel being operated upon.

The device of FIG. 4 is illustrated in a horizontal position. However, it is clear that a panel emerging from the device would curve downwardly requiring the device to be positioned on a high table. To eliminate this requirement, the device may be operated in a vertical manner as by resting it on the legs 52 of one of the members 40. Thus, the panel will pass through the device in a vertical orientation with the curved panel remaining generally within the vertical space of the device. This also will position the driving mechanism 41 at the top of the device which is desirable when the device is powered by an electric drill operating on a shaft within the mechanism 41.

Figure 5:
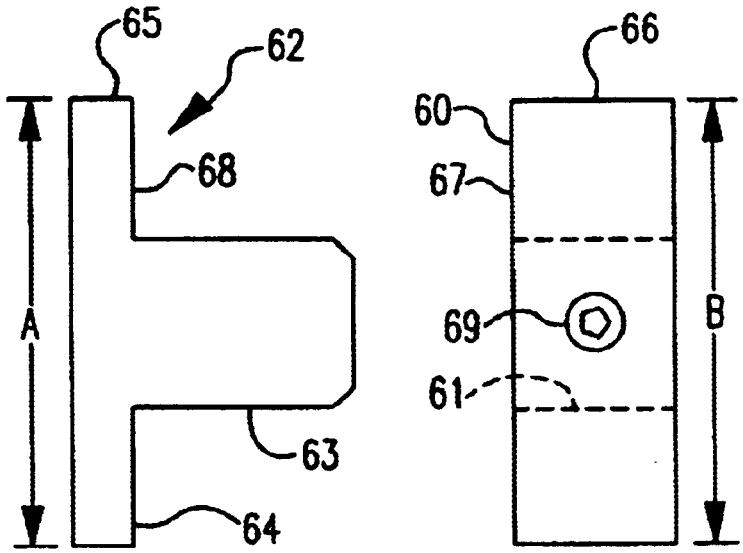
FIG. 5 is an exploded view of a roller assembly employed in the device of FIG. 4.

FIG. 5 is an exploded view of components which form either of the follower blocks 43 and 47 in FIG. 4. As shown in FIG. 5, first block 60 is generally cylindrical having a central bore 61. A second member 62 has a hub 63 configured to extend into the aperture 61 and a cylindrical flange 64. The cylindrical surface 65 of the hub 64 is intended to engage the pan portion of the panel (see FIG. 1). For this purpose, the dimension A is slightly larger than the dimension B such that, on insertion of the hub 63 in the aperture 61, the surface 65 extends slightly beyond the surface 66 of the member 60. The groove 51 illustrated in FIG. 4 is formed between the opposing faces 67 and 68 of the members 60 and 62. The spacing between the faces 67 and 68 is established by the amount of insertion of the hub 63 in bore 61 with the desired spacing being maintained by a threaded bore and set screw 69 in the member 60. As is well known in the art, the set screw engages the hub 63 within the bore 61 to secure the pieces illustrated in FIG. 5 into a single unit.

Figure 6:
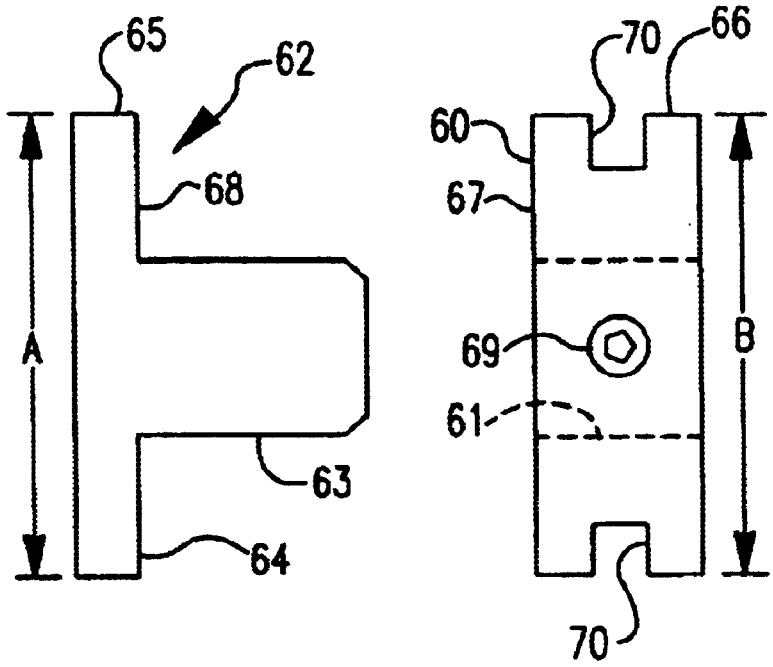
FIG. 6 is an exploded view of a modified roller assembly.

An alternative embodiment to the follower block of FIG. 5 is illustrated in FIG. 6. The single difference between the embodiments of FIG. 5 and FIG. 6 is a groove 70 extending around the entirety of the surface 66 of the member 60. Other like elements are numbered identically to the elements of FIG. 5. The purpose of the grooves 70 is described below.

Figure 7:
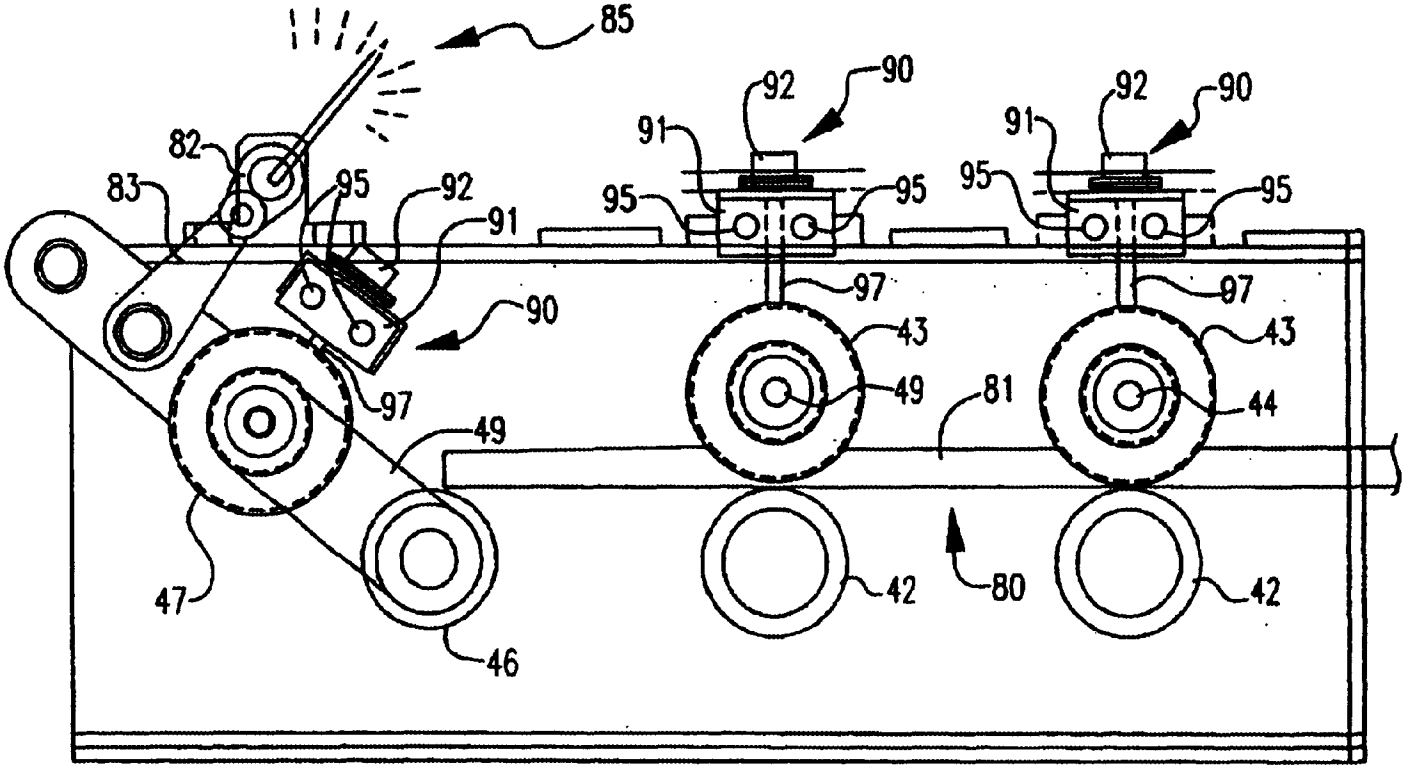
FIG. 7 illustrates a further embodiment of a panel arching device in accordance with the present invention.

FIG. 7 illustrates a further embodiment in accordance with the present invention. With the device in a vertical orientation, FIG. 7 represents a top view with the upper housing supports removed for the sake of clarity. As shown, a member 80 to be arched has passed through the driving section of rollers 42 and follower blocks 43 to the point where it just engages the roller 46. Side elements 81 are within grooves of the follower blocks 43 as described above with reference to the pan 10 and legs 12. The links 49 (one shown in FIG. 7) are pivoted about the rotational axis of the roller 46 to carry the follower blocks 47. In this embodiment, a crank 82 is carried by the housing and connected to a link 49 via a connecting rod 83 such that rotation of the crank 82 causes the link 49 to pivot about the rotational axis of the roller 46. The linkages illustrated in FIG. 7 are shown at the maximum rotation with the rotation of the crank 82 in either direction causing a movement of the followers 47 upward and to the right. The crank 82 is rotated by a handle 84 which may also serve as an indicator with reference to a scale 85. In practice, the handle 84 and scale 85 would be positioned over the device but are shown in the position illustrated for the sake of clarity. The scale 85 may be calibrated for particular radii in accordance with the position of the follower blocks 47 and the gage of the material being operated upon. The linkage members 49, 82 and 83 may be provided on each end of the roller 46 and followers 49.

In the embodiment of FIG. 7, each of the follower blocks 43 and 47 has an associated positioning mechanism illustrated generally at 90. In this embodiment, the members 43 and 47 of FIG. 7 correspond to the follower block embodiments of FIG. 6 having the groove 70. A positioning rod 97 extends between the positioning mechanisms 90 and each of the follower blocks 43 and 47 and into the groove 70 of those follower blocks.

Figure 8:
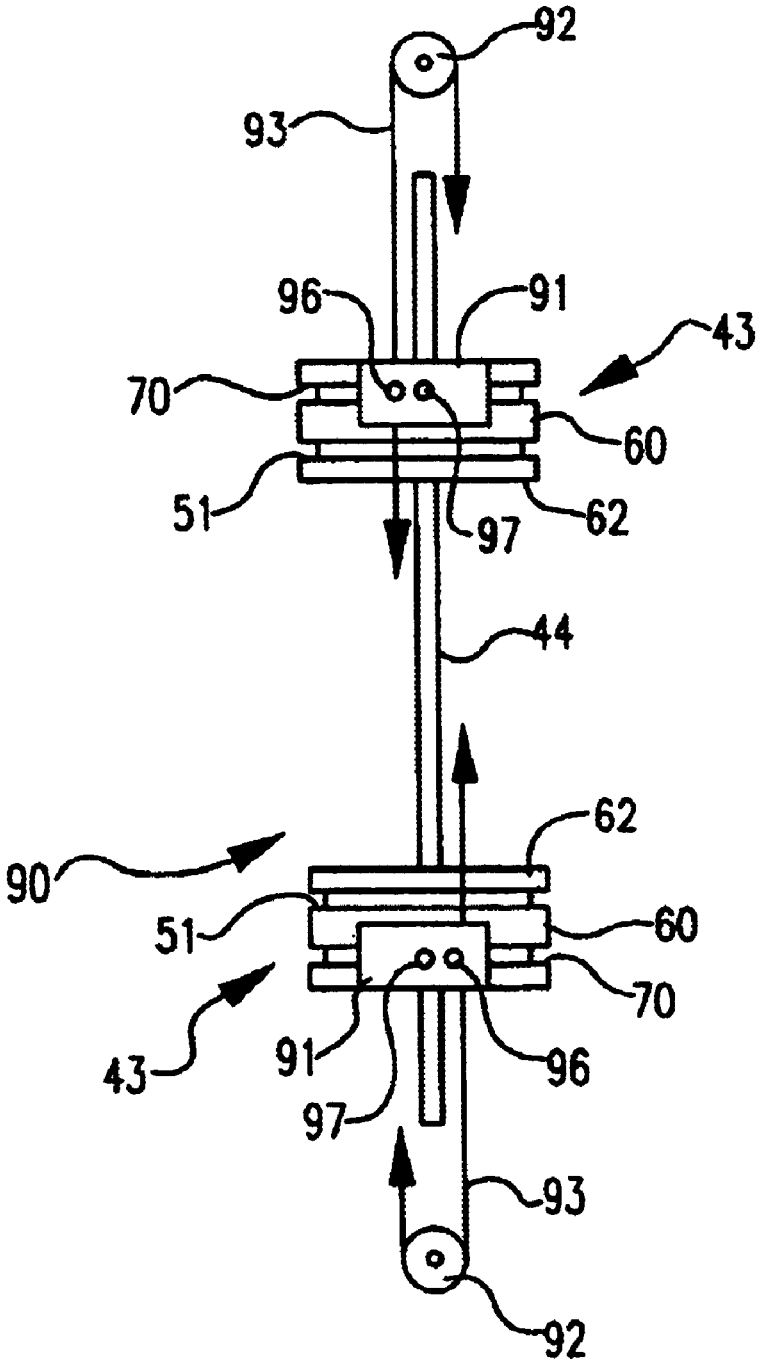
FIG. 8 illustrates a portion of the device of FIG. 7.

Referring now to FIG. 8, the positioning mechanism 90 is illustrated in more detail. In FIG. 8, a shaft 44 carries two follower blocks 43, each including the groove 70. The positioning mechanism associated with the follower blocks 47 operates identically to that illustrated in FIG. 8 and includes a positioning block 91 associated with each of the follower blocks 47. The mechanism illustrated in FIG. 8 may be implemented with either a chain or cable which form a continuous loop about the members 92. The members 92 may be gears in a chain implementation or pulleys in a cable implementation with the chain or cable being illustrated at 93. The ligament 93, as stated, forms a continuous loop about the members 92 passing twice through each of the positioning blocks 91. For this purpose, the positioning blocks 91 are provided with apertures 95 (see FIG. 7). Each of the blocks 91 is pinned or otherwise secured to a different segment of the ligament 93, the securement being illustrated at 96 and being any desired securement method such as a set screw, pin or other device. With the blocks 91 secured to differing ligament segments, movement of one of the blocks will cause the other of the blocks to make a corresponding move in the opposite direction. The pins 97 extending between the positioning blocks 91 and the grooves 70 of the follower blocks 43 cause the follower blocks 43 to move synchronously with the positioning blocks 91 and each other. Thus, a positioning of one of the follower blocks 43 in a desired location causes the other of the follower blocks 43 to be similarly positioned. In many instances, it will be desired to position the follower blocks 43 in a "centered" relation relative to the shaft 44. However, other orientations may be desirable and are possible in the context of the present invention—as by adjustment of the location of the attachment 96 of the positioning blocks 91 and ligament 93. Indeed, with each of the follower blocks 43 and 47 provided with a mechanism such as that as illustrated in FIG. 8, all that is necessary for an initial setup is a measurement of the spacing between the grooves 51 on each of the assemblies with that initial spacing also establishing an alignment between the grooves 51 from assembly to assembly.

Figure 9:
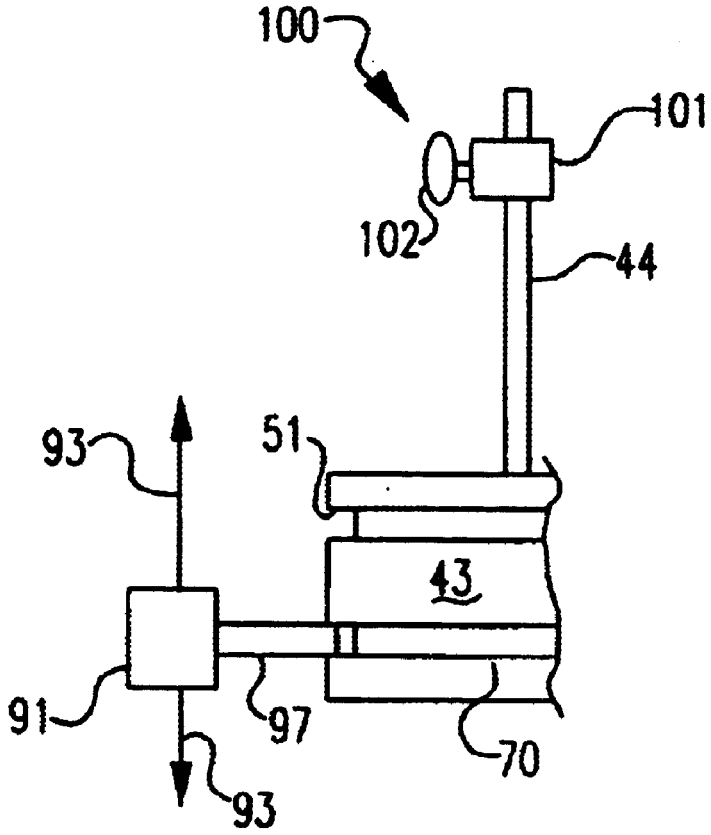
FIG. 9 is a side view of a portion of the apparatus of FIG. 8.

FIG. 9 illustrates a side view of a portion of positioning mechanism 90 of FIG. 8. In FIG. 9, the extension of the pin 97 between the positioning block 91 and groove 70 is illustrated. Also illustrated in FIG. 9 is a stop assembly 100 mounted on shaft 44. Stop Assembly 100 consists of a stop member 101 slidable along the shaft 44 and a threaded bore in stop member 101 and cooperating thumb screw 102. The thumb screw 102 engages the shaft 44 through the threaded bore, in known manner. As will be appreciated by those familiar with the art, the stop member 101 allows the initial position of the follower blocks 43 to be maintained from panel to panel. That is, after initial setup—positioning of the follower blocks 43 in the desired initial position—the stop 101 may be positioned against one of the follower blocks 43 and the thumb screw 102 tightened against the rod 44. After a panel has run through the device and the follower blocks 43 have moved from their initial setting, those blocks may be returned to the initial setting by merely moving them into abutment against the stop member 101. Thus, the initial set up is maintained from panel to panel.

Figure 10:
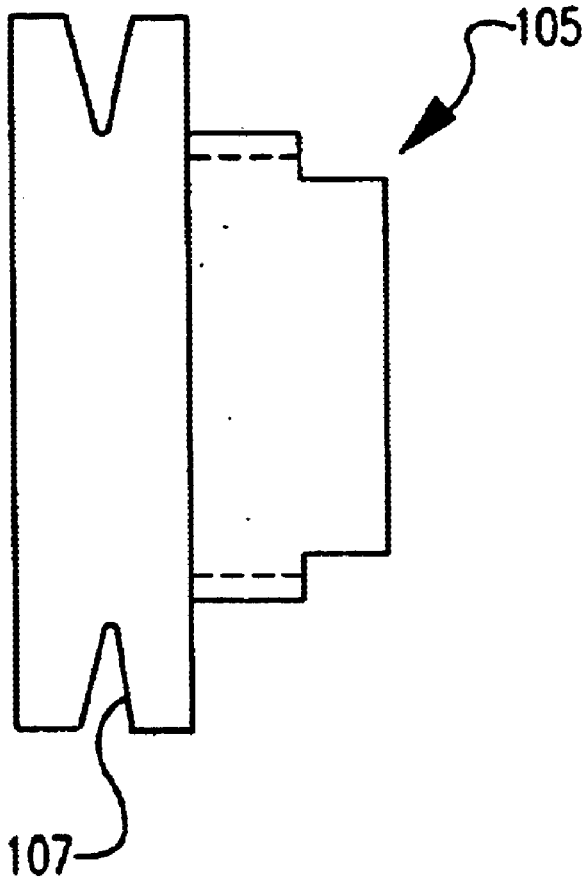
FIGS. 10 and 11 illustrate cooperating roller members utilized to arch a batten.
Figure 11:
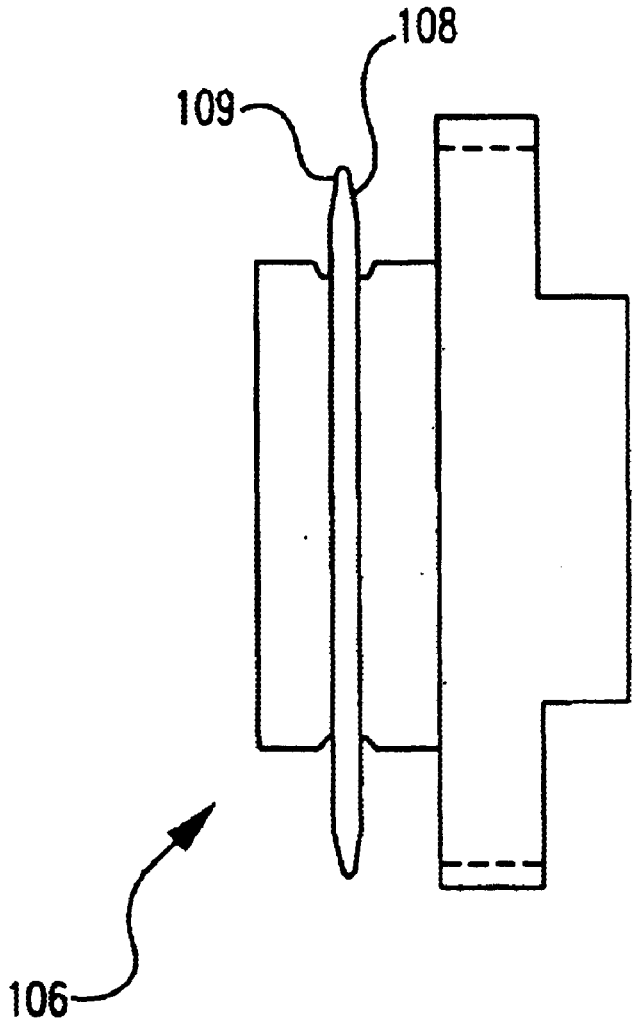
Figure 12:
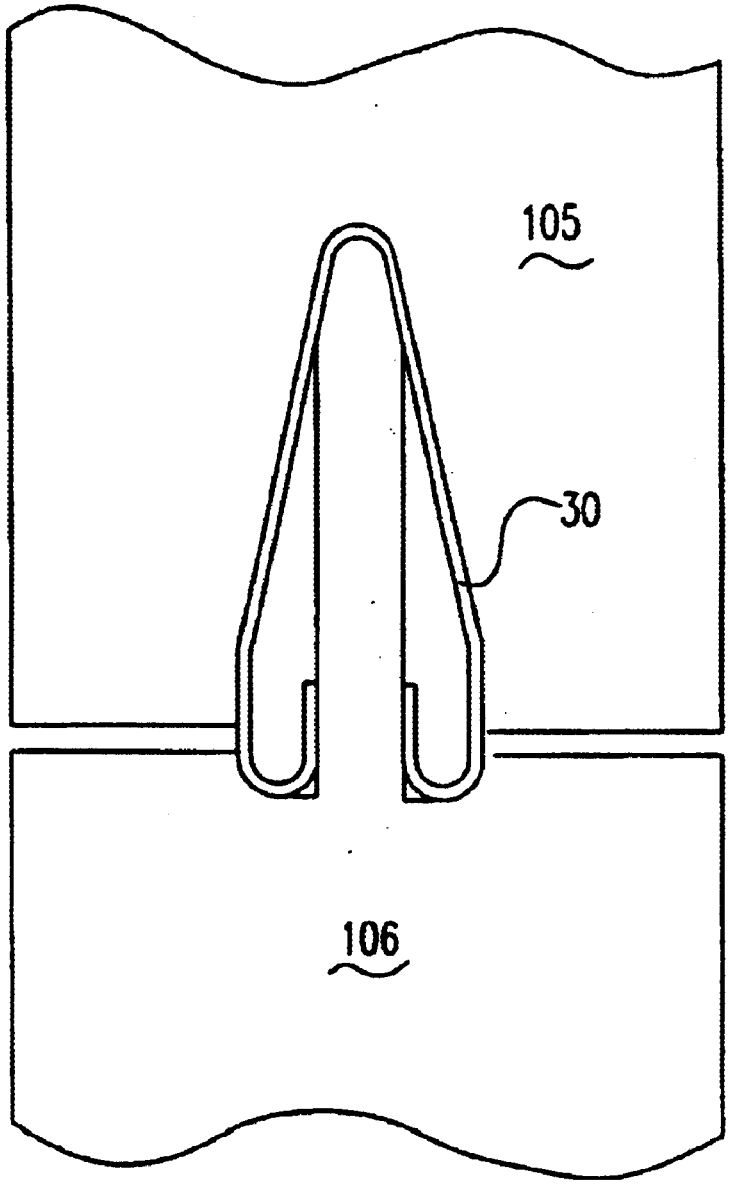
FIG. 12 illustrates the cooperation between the members of FIGS. 10 and 11 and a batten.

As described to this point with regard to FIG. 7, member 80 has represented a panel such as panel 10 having side legs represented at 81. The member 80 may also represent a batten such as that illustrated in FIG. 3 with the element 81 corresponding to the sides 31, 33 of the batten 30. In this instance, the rollers 42 and 46 and follower blocks 43 and 47 are replaced by alternative members illustrated in FIGS. 10 and 11. The follower member illustrated in FIG. 10 is a replacement for the follower blocks 43 and 47 and is designated generally at 105. The roller member illustrated in FIG. 11 is designated generally at 106 and is a replacement for the rollers 42 and 46. In this replacement, a single follower member 105 replaces a pair of follower blocks such that a single batten runs through the machine at a time. Thus, the positioning mechanisms 90 are not necessary. However, the linkage of members 49, 82, 83 and 84 are retained along with the scale 85. As shown in FIG. 10, member 105 has a groove 107 generally corresponding to the outer configuration formed by the side legs of a batten 30 while the member 106 includes a disc-shaped member 108 having a nose 109 which corresponds generally to the inner configuration of the batten 30 to engage the underside of the batten. The cooperation of members 105 and 106 with a batten 30 are illustrated in FIG. 11. With this configuration, it is desirable, and may be necessary, to move each of the cooperating elements 105 and 106 synchronously with each other and with corresponding elements along the travel path of the batten. Suitable modifications to the drive mechanisms illustrated at 41 in FIG. 4 are within the scope of those skilled in the art. It has been found that with the configuration shown it is possible to successfully advance a batten through the device to provide the desired arch in the batten without damage to the surface finish of the batten.

Many modifications and variations of the present invention are possible in light of the above teachings. For example, additional stages may be added to the device such that a flat panel may have its side legs initially formed and then advanced into the arching device described above. Similar preforming may be utilized to form a batten of desired configuration before feeding the same into the arching device. Also, to facilitate the handling of a panel, and particularly a large or long panel, it may be desirable to provide a "trolley" to support the trailing edge of a panel as it passes through the device. Such a trolley has been assembled and consists, essentially, of rollers with an upstanding support, the support including members which engage the upper and lower legs of the panel to support the panel and hold it vertical as the panel advances through the device. Of course, the panel must be supported by the trolley in a manner such that it will be released as the trailing edge of the panel enters the forming device. It is therefore to be understood that, within the scope of the appended claims, the invention may be practiced otherwise than as specifically described.

What is claimed is:

1. Apparatus for forming an arch in architectural panels of the type having an underside and side legs, the apparatus comprising a drive section and an arching section, each of said driving and arching sections including at least one roller and cooperating followers, said at least one roller adapted to engage the underside of the architectural panel, said cooperating followers each having a groove configured to accept the side legs of the architectural panels, said cooperating followers received upon a shaft, each of said cooperating followers being free to axially slide upon said shaft during formation of the arch in the architectural panel.

2. The apparatus of claim 1 wherein said arching section roller is rotatable about an axis and further comprises link means pivotable about said axis, said link means supporting an arching section follower for rotation about said arching section roller axis.

3. The apparatus of claim 2 wherein there are two driving section rollers.

4. The apparatus of claim 2 further comprising means for driving architectural panels through said apparatus wherein said means comprises means for rotating said driving section rollers.

5. The apparatus of claim 4 wherein there are two driving section rollers.

6. The apparatus of claim 4 wherein said panel driving means comprises means for synchronously driving each of said rollers and followers.

7. The apparatus of claim 6 wherein there are two driving section rollers.

8. The apparatus of claim 2 wherein each of said driving and arching section rollers have a set of two cooperating followers.

9. The apparatus of claim 8 wherein there are two driving section rollers.

10. The apparatus of claim 9 further comprising means for driving architectural panels through said apparatus said means comprises means for synchronously rotating said driving section rollers.

11. The apparatus of claim 9 further comprising means for driving architectural panels through said apparatus said means comprises means for synchronously rotating said driving section and arching section rollers.

12. The apparatus of claim 8 wherein each set of cooperating followers rotate about a common axis and are movable relative to each other along said axis.

13. The apparatus of claim 8 wherein each set of cooperating followers rotate about a common shaft and float along that shaft to accommodate variations in side leg spacing along a panel.

14. The apparatus of claim 13 further comprising means for synchronizing movement of cooperating followers within said set along their common shaft.

15. The apparatus of claim 1 wherein said groove of each of said followers is selectively configurable.

16. The apparatus of claim 15 further comprising means for setting initial follower positions.

17. The apparatus of claim 15 wherein said followers comprise a first cylindrical member having a central bore, and a second member having a hub and a cylindrical flange extending therefrom, said hub being within said bore, a spacing between said cylindrical flange and said first cylindrical member selectively establishing a width for each follower groove.

18. An apparatus for imparting a radius bend in a tapered architectural panel, said apparatus comprising a bending mechanism, and a series of panel driving members and a series of panel guiding members through which the tapered architectural panel passes, each of said panel guiding members of said series of panel guiding members comprising a pair of panel engaging followers, said followers being axially translatable upon a shaft during bending of the tapered architectural panel in response to the taper thereof, said bending mechanism comprising at least a single panel guide member of said series of panel guide members, said at least a single panel guide member being pivotable with respect to a corresponding panel driving member of said series of panel driving members.

19. The apparatus of claim 18 wherein said followers include a surface adapted to receive an edge of the tapered architectural panel.

20. The apparatus of claim 18 wherein said followers are variably configurable for receipt of an edge of the tapered architectural panel.

21. The apparatus of claim 20 wherein said followers comprise first and second members, said members being selectively united so as to define a channel for receipt of an edge of the tapered architectural panel.

22. The apparatus of claim 21 wherein said first member comprises a cylinder having a central bore for receipt of a portion of said second member.

23. The apparatus of claim 22 wherein said second member comprises a hub from which extends a cylindrical flange, said hub being variably affixed within said central bore of said first member.

24. The apparatus of claim 18 further comprising follower positioning means, each of said followers adapted for operative engagement with a portion of said follower positioning means, said followers of said panel guide members of said series of panel guiding members being thereby synchronously responsive to said follower positioning means.

25. The apparatus of claim 24 wherein said follower positioning means comprise rods for engagement with both of said followers of each of said guiding members of said series of guiding members.

26. The apparatus of claim 25 wherein said each of said followers include a profiled surface for receipt of said rods.

27. An apparatus for imparting a radius bend in an architectural element, said apparatus comprising a bending mechanism, and a series of element driving members and a series of element guiding members through which the architectural element passes, each of said element guiding members of said series of element guiding members comprising an element engaging follower, said follower being free to slide upon a shaft during bending of the architectural element, said bending mechanism comprising at least a single element guide member of said series of element guide members, said at least a single element guide member being pivotable with respect to a corresponding element driving member of said series of element driving members.

* * * * *